US005289756A

United States Patent [19]

Kobelt

[11] Patent Number: 5,289,756

[45] Date of Patent: Mar. 1, 1994

[54] MARINE STEERING APPARATUS

[75] Inventor: Jacob Kobelt, Surrey, Canada

[73] Assignee: Kobelt Manufacturing Co. Ltd., Richmond, Canada

[21] Appl. No.: 56,847

[22] Filed: May 4, 1993

Related U.S. Application Data

[63] Continuation of Ser. No. 818,689, Jan. 3, 1992, abandoned.

[51] Int. Cl.[5] ..... F15B 9/10; B63H 25/08

[52] U.S. Cl. ..... 91/368; 91/392; 60/384; 60/385; 440/62; 114/114; 114/154

[58] Field of Search ..... 60/384, 385, 386, 387, 60/389; 91/368, 392; 137/625.26, 625.69; 114/144 R, 154, 162; 440/62

[56] References Cited

U.S. PATENT DOCUMENTS

| | | | |
|---|---|---|---|
| 2,236,467 | 3/1941 | Clench | 60/384 |
| 2,794,424 | 6/1957 | May | 60/384 |
| 3,370,422 | 2/1968 | Carlson et al. | 60/384 |
| 3,584,537 | 6/1971 | Schulz | 60/384 X |
| 5,127,856 | 7/1992 | Kabuto et al. | 440/62 X |

FOREIGN PATENT DOCUMENTS

| | | | |
|---|---|---|---|
| 2513877 | 10/1975 | Fed. Rep. of Germany . | |
| 3910891 | 10/1989 | Fed. Rep. of Germany | 440/62 |
| 418494 | 11/1934 | United Kingdom . | |

OTHER PUBLICATIONS

"Hydraulic Power Steering For Commercial and Pleasure Boats to 80 Ft." by Hynautic of Sarasota, Florida, Aug. 1990.

*Primary Examiner*—Edward K. Look
*Assistant Examiner*—Hoang Nguyen
*Attorney, Agent, or Firm*—Shlesinger, Arkwright & Garvey

[57] ABSTRACT

A fluid power apparatus is connected to a pressurized fluid supply and a conventional helm pump controlled by the helm of a vessel to shift the rudder. The apparatus comprises an actuator cylinder connectable to the rudder, and a servo cylinder and a main valve connected to the helm pump to pass fluid therebetween and between the actuator cylinder. The actuator cylinder and servo cylinder have respective bodies and piston rods, and portions of the servo cylinder and actuator cylinder are connected together for concurrent simultaneous movement along respective longitudinal axes. Valve shifting structure is responsive to a change in fluid signal from the helm pump applied to the servo apparatus. Fluid diverting structure is responsive to a threshold supply pressure so as to actuate the valve to stop flow of supply fluid when supply pressure drops below the threshold pressure. When pressurized fluid is available, the valve is actuated in response to a fluid signal from the helm pump and the actuator cylinder receives pressurized fluid from the valve and directs fluid back to the valve. When pressurized fluid is not available, the valve is actuated in response to a fluid signal from the helm pump and the valve is effectively by-passed and the actuator cylinder receives fluid from the helm pump and is actuated by manually applied pressures.

20 Claims, 4 Drawing Sheets

MARINE STEERING APPARATUS

CROSS REFERENCE TO RELATED APPLICATION

This application is a continuation of U.S. application Ser. No. 07/818,689, filed Jan. 3, 1992, now abandoned, which is incorporated herein by reference.

BACKGROUND OF THE INVENTION

The invention relates to a fluid power apparatus, in particular a marine steering apparatus particularly for use when a conventional, manually-operated helm pump to effect steering of a rudder of a marine vessel.

Helm pumps are well known for actuating rudders of marine valves, a typical helm pump being found in U.S. Pat. No. 3,935,796 issued to Teleflex Inc., inventor Robert A. R. Wood. In this patent, swash plate pump is manually rotated to supply fluid under pressure to one portion of the rudder actuator, and to receive fluid from the opposite portion of the rudder actuator. The patent discloses a variable delivery pump so that, in relatively calm seas where rudder forces are relatively low, the pump is operated in a relatively high flow delivery configuration, such that relatively few turns of the helm delivers sufficient fluid to actuate the rudder from lock to lock. In heavier seas which impose higher force on the rudder, the flow delivery of the pump can be manually changed to a relatively low flow delivery configuration, and many turns of the helm are then required to actuate the rudder from lock-to-lock. This reduces forces on the helm, and operator fatigue.

To overcome operator fatigue for larger vessels, it is well known to provide a power steering system in which an engine driven pressurized fluid supply is directed through a directional valve to an appropriate side of the rudder actuator, to move the rudder in the desired direction. The directional valve is actuated by the helm, and when the pressurized fluid supply is available, a relatively small number of turns of the helm is required to shift the rudder from lock to lock, with relatively little operator fatigue. However, should the pressurized fluid supply fail, a manually operated emergency steering system is required, and this is usually a direct mechanical system which usually requires direct manual engagement and some considerable operator force which cannot be sustained for long periods.

It is known to provide a power steering system as above described with a hydraulically actuated helm pump back-up system which is available should the pressurized fluid supply fail. In one example known to the inventor, as supplied by Hynautic Inc. of Florida, U.S.A., should normal pressurized fluid supply fail, a manually actuated helm pump is available to permit shifting of the rudder with a helm force less than that would be encountered with the normal direct mechanical emergency steering system. However, the Hynautic system known to the inventor involves many components which require separate installation in the vessel, with extensive hydraulic plumbing connections and adjustments, which increases the cost of installation and servicing of the system.

SUMMARY OF THE INVENTION

The invention reduces the difficulties and disadvantages of the prior art by providing a fluid power apparatus for marine steering which is mechanically and hydraulically relatively simple. Furthermore, the invention is an integrated unit which facilitate installation into a marine vessel by requiring relatively few hydraulic connections into the hydraulic power and steering system, and relatively few mechanical connections to the structure of the vessel and rudder assembly. The apparatus can be quickly connected to a pressurized fluid supply and a manually actuated helm pump and rudder assembly. The invention permits powered steering with low operator fatigue when pressurized fluid is available, and should the pressurized fluid supply fail, the invention provides essentially instantaneous automatic conversion to a manual emergency or back-up system which applies forces through the helm pump, without requiring a separate manual engagement of the separate back-up system. The invention is also compatible with some electrical remote control devices, and with some auto-pilot devices which generate hydraulic directional signals.

The fluid power apparatus according to the invention comprises an actuator apparatus, a servo apparatus, a main valve and a valve shifting means. The actuator apparatus has an actuator body and an actuator piston rod, the piston rod having an actuator piston mounted thereon. The actuator body has first and second actuator ports located on opposite sides of the piston. The actuator body and piston rod are mutually extensible and retractable along a longitudinal actuator axis. The servo apparatus has a servo body and a servo piston rod, the servo piston rod having a servo piston mounted thereon. The servo body has first and second servo ports located on opposite sides of the servo piston and being communicable with a helm pump. The servo body and servo piston rod are mutually extensible and retractable along a longitudinal servo axis, the servo axis being parallel to the actuator axis. Portions of the servo apparatus and the actuator apparatus are connected together for concurrent simultaneous movement along the respective longitudinal axis. The main valve has a valve body portion and a valve spool portion, the valve body portion having first and second signal ports, first and second helm ports, a supply port and at least one sump port. The first and second signal ports communicate with the first and second actuator ports respectively of the actuator body to transmit fluid therebetween. The first and second helm ports are communicable with the helm pump to transmit fluid therebetween. The supply port receives supply fluid at supply pressure when available and the sump port is communicable with a sump. The valve portions are moveable relative to each other to control fluid flow through the ports of the valve body. The valve shifting means is for shifting the main valve apparatus between first and second positions thereof to change supply fluid flow through the valve. The valve shifting means is responsive to a change in fluid signal direction from the helm pump applied to the servo apparatus.

Preferably, the valve shifting means comprises one valve portion connected to the actuator apparatus, and another valve portion connected to the servo apparatus, the valve portions being shiftable relative to each other along a valve axis disposed parallel to the actuator axis and servo axis to change fluid flow through the valve. Also, preferably the valve shifting means comprises lost motion means for providing pre-determined lost motion between the servo apparatus and the actuator apparatus. The lost motion means provides sufficient axial movement between the valve spool and the valve body to permit shifting of the valve portions relative to each other to change supply fluid flow through the main valve.

Preferably, the apparatus further comprises fluid directing means for directing fluid supply to the main valve so that when the supply fluid pressure is greater than a threshold pressure, the supply fluid is fed into the actuator apparatus, or alternatively, when the supply fluid pressure is less than threshold pressure, the main valve directs fluid from the helm pump to the actuator apparatus. In one embodiment, the servo piston rod and the actuator piston rod are connected rigidly together for concurrent movement along respective axes of extension and retraction. In the same embodiment, the valve body is connected rigidly to the actuator body, the valve spool is connected rigidly to the servo body for concurrent movement parallel to the actuator axis, and body coupling means couple the actuator body to the servo body with sufficient clearance therebetween to provide predetermined lost motion therebetween to permit the servo body to move axially relative to the actuator body an amount sufficient to shift the valve spool.

A detailed disclosure following, related to drawings, describes a preferred embodiment of the invention which is capable of expression in apparatus other than that particularly described and illustrated.

DETAILED DISCLOSURE

FIGS. 1-4

Figure 1:
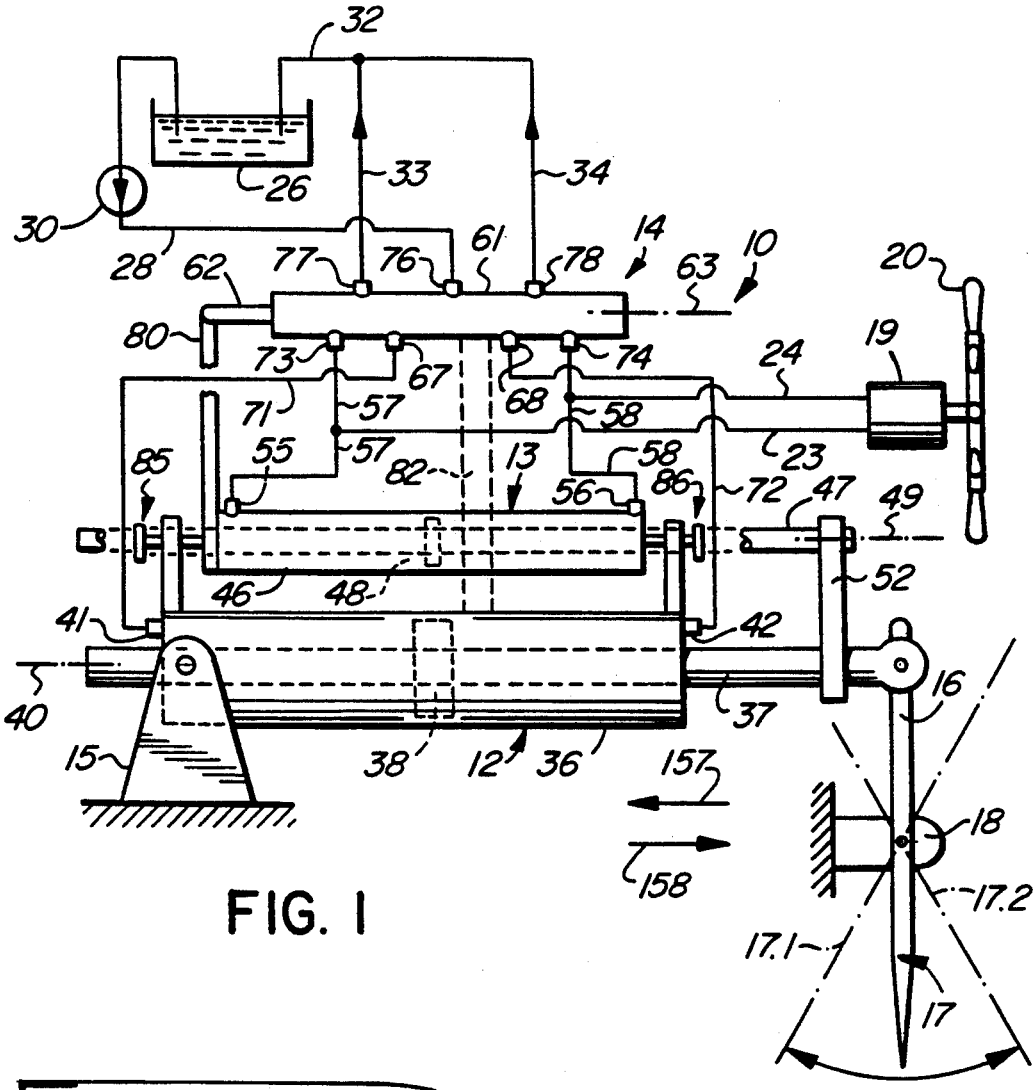
FIG. 1 is a simplified diagram showing main portions of an apparatus according to the invention and respective connections to a hydraulic supply of a marine vessel, a helm pump, and rudder steering assembly.
Figure 2:
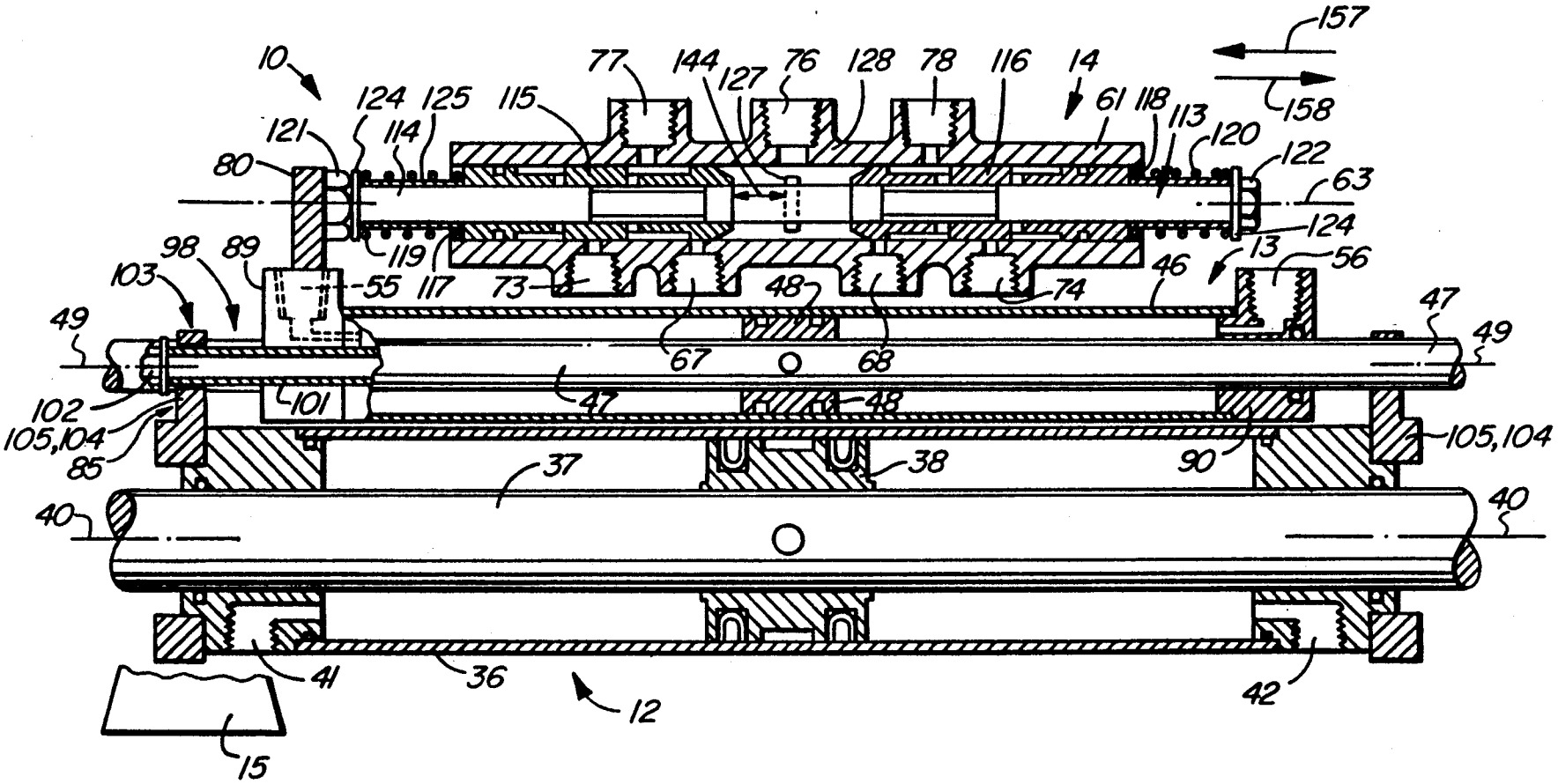
FIG. 2 is a simplified, fragmented, diagrammatic longitudinal section through main components of the apparatus, the apparatus being shown operating with a pressurized fluid supply, a main valve thereof being shown in a first configuration in a centred or closed position thereof reflecting zero rudder signal, some of the components being repositioned and/or disconnected from other components for clarity.

FIG. 1 shows highly diagrammatic representations of hydraulic fluid connections and mechanical connections between the main components, and relative positions are distorted. Referring to FIGS. 1 and 2, a fluid power apparatus 10 according to the invention includes an actuator apparatus 12, a servo apparatus 13 and a main valve 14. A mounting bracket 15 is secured to a portion of the vessel and hinged to an end of the actuator 12 to trunnion mount one portion of the apparatus 10. The apparatus is shown cooperating with a tiller arm 16 which controls a rudder 17, which is journalled on a rudder bearing bracket 18 and can be swung between hard left and hard right positions 17.1 and 17.2 respectively. A conventional hydraulic helm pump 19 is rotated by a helm wheel 20, and communicates with the apparatus through first and second helm lines 23 and 24 respectively. The helm pump 19 can be a swash-plate pump of the type shown in said U.S. Pat. No. 3,935,796. Pumps of this type are fitted with integral hydraulic lock valves which main pressure within the lines 23 and 24. A hydraulic fluid sump 26 has a supply line 28 extending therefrom through a hydraulic power pack 30 which comprises a filter, a hydraulic pump, a pump pressure regulator and other equipment necessary to supply the apparatus with hydraulic fluid at an essentially constant supply pressure e.g. within a range of between about 300 and 1,000 p.s.i. (21 and 70.3 kg. per sq. cm.), and at sufficiently high delivery rate. A sump return line 32 returns fluid to the sump from first and second sump lines 33 and 34 extending from the valve 14.

The actuator apparatus 12 has an actuator cylinder body 36 and an actuator piston rod 37, the piston rod having an actuator piston 38 (broken outline in FIG. 1) mounted thereon. The actuator cylinder body and piston rod are mutually extensible and retractable along a longitudinal actuator axis 40. The actuator body has first and second actuator ports 41 and 42 located on opposite sides of the piston.

The servo apparatus 13 has a servo cylinder body 46 and a servo piston rod 47, the servo piston rod having a servo piston 48 (broken outline in FIG. 1) mounted thereon. The servo cylinder body and the servo piston rod are mutually extensible and retractable along a longitudinal servo axis 49, the servo axis 49 being parallel to the actuator axis 40. Adjacent outer ends of the piston rods 38 and 47 are connected together by a rigid rod connector 52 for concurrent simultaneous movement along the respective longitudinal axes 40 and 49. The servo body has first and second servo ports 55 and 56 located on opposite sides of the servo piston 48 and communicating with the helm pump 39 through first and second branch lines 57 and 58 respectively which are connected to the first and second helm lines 23 and 24.

Both the servo apparatus and the actuator apparatus are balanced, that is, the respective piston rods have a constant cross-sectional area and pass through end portions of the respective cylinders. Thus, for relative movement between a particular piston and cylinder, equal volumes of fluid are displaced on opposite sides of the respective piston. However, as will be described, the servo apparatus has a volume displacement which is less than corresponding volume displacement of the actuator apparatus. Preferably, the volume displaced by the servo apparatus is relatively small, so that the servo apparatus executes a full stroke for a relatively small number of turns of the helm wheel. This is to reduce fluid displacement necessary to effect rudder shifting, so as to maintain a reasonably fast speed of response of the apparatus. Area of the actuator piston is greater than the servo piston to generate sufficient force to actuate the rudder.

The main valve 14 has a valve body portion 61 and a valve spool portion 62, the valve portions being shiftable relative to each other along a valve axis 63 disposed parallel to the actuator axis 40 and the servo axis 49 to change fluid flow through the valve. The valve body portion has first and second signal ports 67 and 68 communicating with the first and second actuator ports 41 and 42 respectively through first and second actuator lines 71 and 72 to transmit fluid therebetween. The valve body portion also includes first and second helm ports 73 and 74 communicating through the first and second branch lines 57 and 58 with the first and second servo port 55 and 56, and through the first and second helm lines 23 and 24 with the helm pump 19 to transmit fluid therebetween. The valve body also has a supply port 76 to receive the supply fluid in the supply line 28, and first and second sump ports 77 and 78 which communicate with the first and second sump lines 33 and 34.

Figure 3:
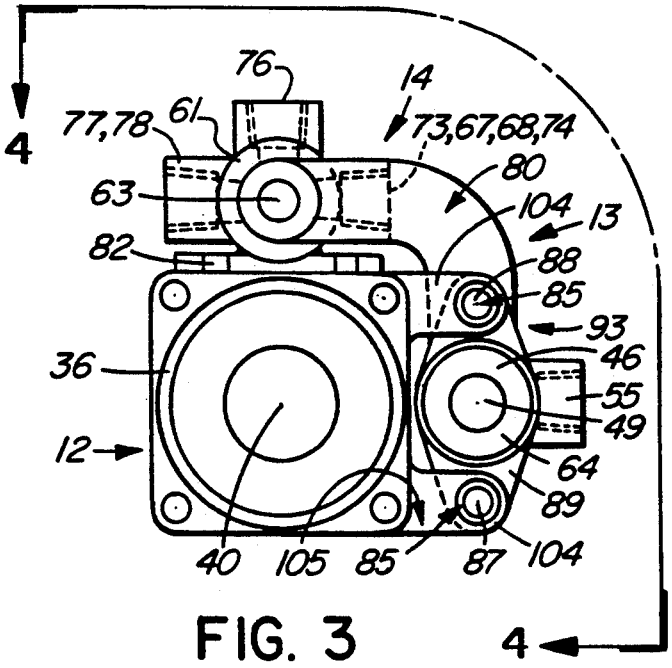
FIG. 3 is a simplified, fragmented end elevation of the main components of the apparatus showing some mechanical connections therebetween.

Referring mainly to FIG. 3, the actuator apparatus 12 and the servo apparatus 13 are located closely adjacent each other with longitudinal axes 40 and 49 thereof disposed within a first undesignated horizontal, plane. The main valve 14 is closely located adjacent the actuator apparatus so that the longitudinal axes 63 and 40 of the valve and actuator apparatus are disposed within a second undesignated vertical plane. The second plane is disposed at a right angle to the first plane, and thus it can be see that the three main components are located so that longitudinal axes thereof are parallel to each and, when viewed axially, form vertices of a triangle. Thus, the three main components, namely the apparatus 12 and 13 and the valve 14 are disposed in a compact, close-coupled non-planar array which simplifies installation and servicing of the apparatus and has other advantages as will be described. An elbow-shaped spool connector 80 extends from the valve spool portion 62 to the servo body 46 to provide a rigid connection therebetween to actuate the valve 14. The valve body portion 61 is connected rigidly by a valve body connector 82 e.g. a flange and threaded fasteners, to the actuator body 36. The servo body 46 is connected to the actuator body 36 with first and second body coupling means 85 and 86 which provide a predetermined relative axial movement or lost motion therebetween, as will be described with reference to FIGS. 2–4.

Figure 4:
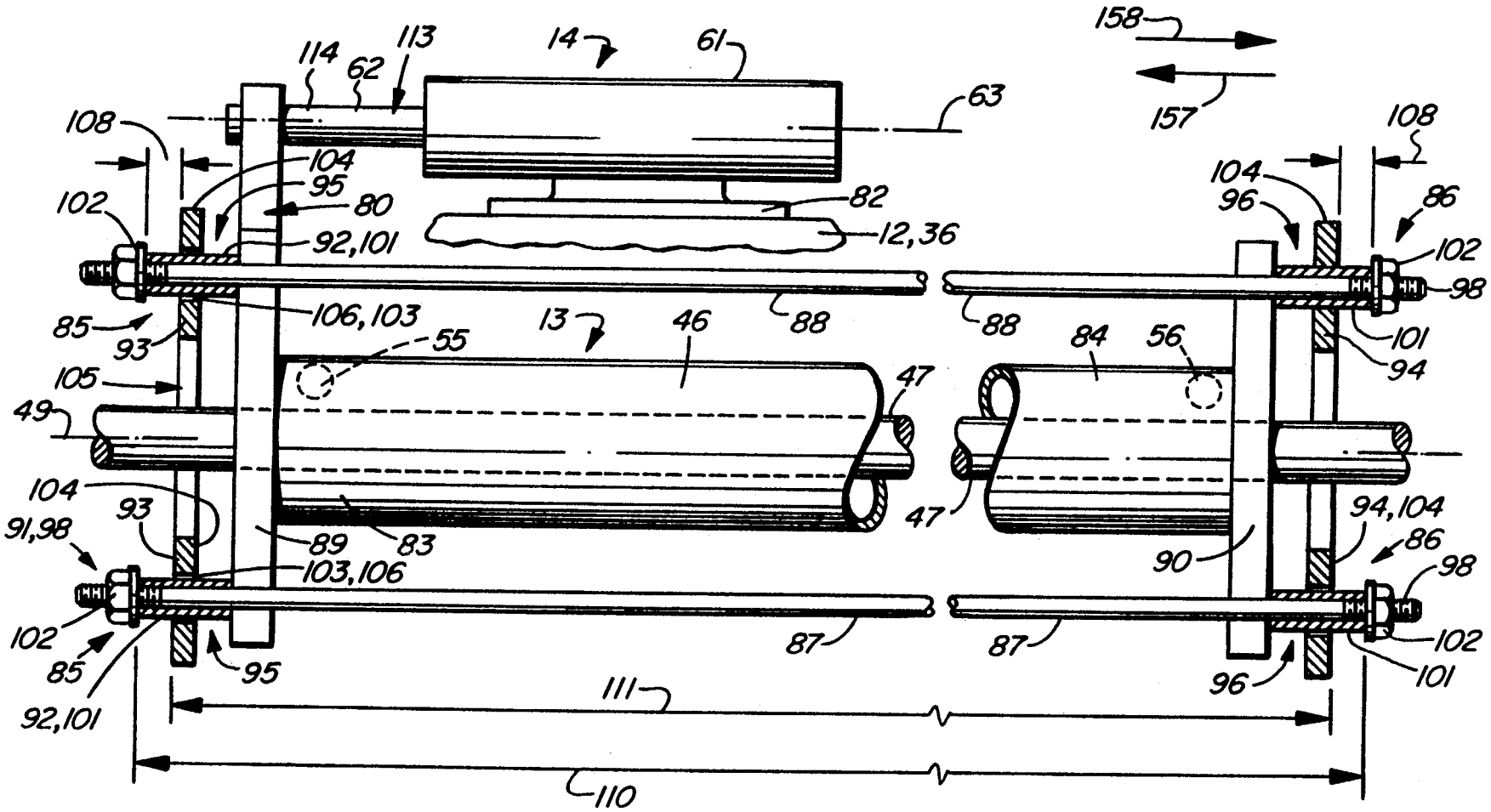
FIG. 4 is a simplified, fragmented, diagrammatic, side elevation of a servo apparatus and main valve as seen generally from a curved line 4—4 of FIG. 3, showing the servo apparatus centred with respect to an actuator apparatus and some portions in section to illustrate lost motion provisions between two of the main components of the apparatus.

Referring to FIGS. 2–4, the first and second body coupling means 85 and 86 are provided adjacent first and second end portions 83 and 84 of the servo body 46 and are essentially identical. The coupling means 85 and 86 comprise first and second actuator connector portions 93 and 94 and first and second servo connector portions 95 and 96, which are connected to the actuator body and servo body respectively.

As best seen in FIGS. 3 and 4, the servo connector portions 95 and 96 are four end portions of a pair of similar, parallel tension rods 87 and 88 located on opposite sides of the servo body 46 and connecting first and second end caps 89 and 90 together as is in common practice. The rods and end caps are similar and the structure adjacent the first end portion 83 only will be described with reference to FIGS. 2 through 4. An outer end of the rod 87 is screw threaded and extends outwardly from the cap 89 and carries a nut and washer combination 91 and a short sleeve 92 located between the washer and the end cap 89. The remaining ends of the rods 87 and 88 are similarly threaded and provided with respective nuts, washers and sleeves for servo connector portions. Thus, there are four similar servo connector portions, two being provided at each end of the servo cylinder. A typical servo connector portion can be seen to have a male means 98 extending from the end portion of the servo body, the male means having a neck portion 101, i.e. the sleeve 92, and an expanded head portion 102, i.e. the nut and washer combination 91 at an outer end to serve as a stop. Other types of stops can be provided as will be described.

The end portions of the actuator cylinder body 46 have similar actuator connector portions 93 and 94 to cooperate with the respective servo connector portion 95 and 96. The first actuator connector portion 93 comprises a plate-like connector member 105 having a pair of ears 104, each ear having an opening 106 to receive the sleeve 92 as a sliding fit therein. The ears at each end of the actuator apparatus are spaced laterally apart to provide clearance for the servo apparatus. The openings 106 of the ears 104 serve as a female means 103 of the actuator apparatus to cooperate with the male means 98 of the servo apparatus. The opening 106 is smaller than the expanded head portion 102 and larger than the neck portion 101. The ears 104 are narrower than length of the sleeve 92 to permit a predetermined axial movement of the neck portion 101 within the opening 106 as follows.

When the servo body is centered with respect to the actuator body as shown in FIG. 4, an axial spacing 108 exists between the male means 98 of the servo body, i.e. the washers of the servo body portion and the female means 105 i.e. the ears 104 of the actuator body at opposite ends thereof. The axial spacing 108 provides the said predetermined relative axial movement between the actuator body 36 and the servo body 46 and is critical to the invention, and is determined as follows. A servo stop spacing 110 is axial distance between inwardly facing faces of the washers of the head portions 102 at opposite end portions of the servo body. Actuator stop spacing 111 is axial spacing between outwardly facing faces of the ears 104 of the connector members 105 at opposite ends of the actuator body. The difference between the servo stop spacing 110 and the actuator stop 111 spacing represents total distance that the servo body can move axially with respect to the actuator body. Clearly, when the servo body and actuator body are centered with respect to each other as shown in FIG. 4, the total distance one body can move with respect to the other is divided equally at opposite ends and is represented by the axial spacing 108. Clearly, the spacing 110 minus the spacing 111 equals twice the axial spacing 108.

It can be seen that the servo body 46 has generally similar first and second servo connector portions 95 and 96 provided with axially spaced apart first and second stops respectively, namely the inwardly facing faces of the washers of the expanded head portions 102 which are spaced apart at the servo stop spacing 110. Similarly, the actuator body 36 has first and second actuator connector portions 93 and 94 provided with axially spaced apart first and second stops respectively, namely outwardly facing faces of the ears 104 of the connector members 105 which are spaced apart at the actuator stop spacing 111. During an extreme displacement between the two bodies, which occurs during valve shifting as will be described, the washers at one end of the servo body will contact the outwardly facing faces of the actuator connector member 105 at the same end thereof. The first and second actuator connector portions are complementary to the first and second servo connector portions respectively to provide axial movement therebetween equal to difference between the spacings 110 and 111. Clearly, the male and female means can be interchanged between the actuator and servo bodies, and other equivalent lost motion means can be substituted. For example, expanded head portions 102 could be eliminated and instead the end portions 83 and 84 of the servo body could contact the adjacent connector members 105 to limit relative movement between the servo body and actuator body.

FIGS. 2-6

Figure 5:
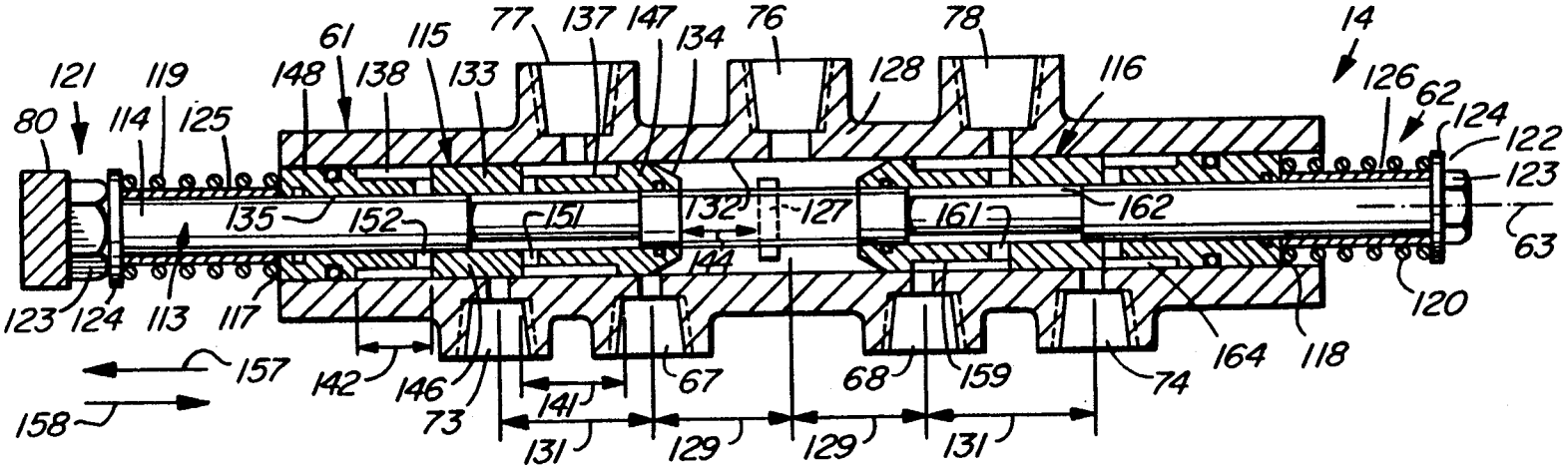
FIG. 5 is a simplified, fragmented, diagrammatic, longitudinal section generally similar to FIG. 2, showing the main valve only, the valve being shown in the first configuration with a relatively high pressure fluid supply, the valve being displaced from the centered position thereof in response to a rudder signal.
Figure 6:
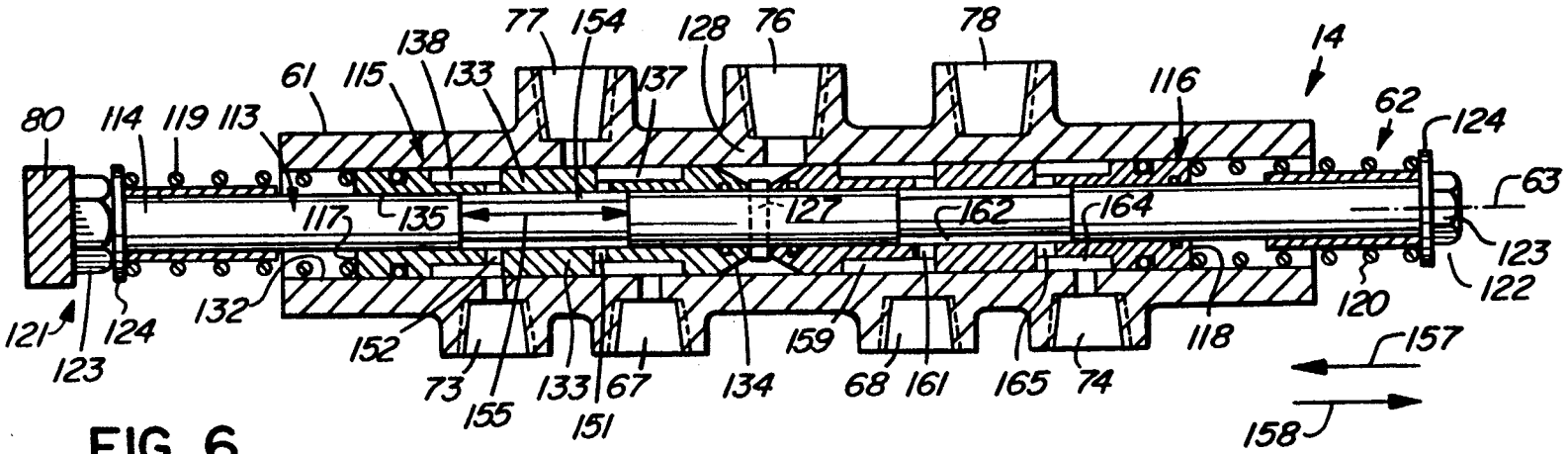
FIG. 6 is a simplified, fragmented diagram of the main valve generally similar to FIG. 5, the valve being shown in a second configuration with a relatively low pressure fluid supply and displaced from the centered position thereof.

Referring mainly to FIGS. 5 and 6, the valve spool portion 62 comprises several elements which are moveable relative to each other. The portion 62 includes a valve spindle 113, and first and second generally similar spool members 115 and 116 mounted on the spindle for axial movement therealong between respective first and second configurations shown in FIGS. 5 and 6 respectively. First and second compression coil springs 119 and 120 are fitted between first and second spring stops 121 and 122 and respective first and second outer ends 117 and 118 of the first and second spool members as shown, so as to urge the spool members towards each other. A centre stop pin 127 extends transversely across a centre position of the spindle 113 to limit inwards movement of the spool members to prevent inner ends of the spool members from passing beyond the centre position of the spindle. First and second spool stops 125 and 126 are fitted between adjacent outer ends of the spool members and the spring stops and limit outwards movement of the spool members. Thus, the spool members have limited motion between the spool stops adjacent outer ends thereof, and the centre stop adjacent the inner ends thereof. The spool stops are sleeves fitted over the spindle and enclosed by the coil springs 119 and 120 and retained by the spring stops 121 and 122. The spring stops are removable to permit assembly and servicing of the spool portion 62, and can be nuts and flat washers 123 and 124 fitted on screw threaded outer ends of the spindle 113.

The valve spool portion 62 is generally symmetrical about the pin 127, with the exception that a first end 114 of the spindle is rigidly connected to the spool connector 80 using the nut from the first spring stop 121.

The supply port 76 is located adjacent an intermediate portion 128 of the valve body, and is generally adjacent the centre stop 127 when the spindle is located centrally relative to the body (as shown in FIG. 2 only). The signal ports 67 and 68 are located at equal shift spacings 129 on opposite sides of the supply port. The first signal port 67 and the first helm port 73 are spaced apart at a valve port spacing 131, and the second signal port 68 and the second helm port 74 are spaced apart at the same valve port spacing 131.

As best seen in FIGS. 5 and 6, the first spool member 115 comprises a generally cylindrical spool body 133 having a truncated conical inner end 134 and the first outer end 117 which is generally annular. Undesignated resilient O-rings and sliding cup seals fitted in respective grooves seal the spool member with respect to a valve bore 132 of the valve body 61, and with respect to a spool bore 135 of the valve spool and the spindle 113. The cylindrical spool body 133 includes inner and outer clearance grooves 137 and 138 which are annular grooves defined by oppositely located shoulders spaced apart at inner and outer axial clearance lengths 141 and 142 respectively. The clearance lengths 141 and 142 are approximately equal, and are also approximately equal to a travel spacing 144 between the centre stop 127 and the inner face 134 when the outer end 117 is contacting the spool stop 125 as shown in FIGS. 2 and 5. The travel spacing 144 represents axial movement or travel of the spool member 115 from the first configuration as shown in FIG. 5 to the second configuration as shown in FIG. 6.

The clearance grooves 137 and 138 are separated by an intermediate land 146, and the spool body also has inner and outer lands 147 and 148 which are adjacent the inner and outer ends 133 and 117 respectively. The member 115 has inner and outer radial passages 151 and 152 which extend from the grooves 137 and 138 respectively to the spool bore 135 enclosing the spindle 113. The spindle 113 has a connector groove 154 which has an axial length 155 which is somewhat greater than axial distance between the two radial passages 151 and 152 to permit communication therebetween when the spool is in the second configuration of FIG. 6. As seen in FIG. 6, in the second configuration the inner and outer clearance grooves 137 and 138 communicate with the first signal port 67 and the first helm port 73 through the passage 151 and 152 and connector groove 154. Thus, when in the second configuration as shown in FIG. 6, the connector groove 154 permits the first signal port and the first helm port to communicate with each other so as to effectively bypass the valve 14 as will be described.

Referring to FIG. 2, when the valve is centred the centre stop pin 127 is aligned with the supply port 76 and thus the spool members are spaced symmetrically from the intermediate portion of the valve when the fluid supply is pressurized. This position represents zero signal to the servo apparatus, that is there is no change in the steering position or rudder angle as established by the helm wheel. The spool members 115 and 116 block the ports 67 and 73, and 68 and 74 respectively and the actuator apparatus 12 and servo apparatus 13 are hydraulically locked. Thus, the first configuration shown in FIG. 2 represents a condition in which inclination of the rudder is constant, and there is essentially zero fluid flow between the valve member, the servo apparatus and the actuator apparatus. In this position, the lost motion between the actuator apparatus and the servo apparatus is in an essentially centered position, and there will be no change from this position until a signal is generated by the helm pump.

Referring to FIG. 5, the main valve 14 is shown with the valve spool portion 62 displaced leftwards in direction of an arrow 157 with respect to the valve body portion. In this position, the first spool member 115 has been shifted an amount sufficient to expose the first signal port 67 to fluid adjacent the intermediate portion 128 of the valve spool, so that fluid under supply pressure entering the supply port 76 passes across the spindle and outwardly through the port 67 to enter the first actuator port 41 (through the line 71 of FIG. 1). Correspondingly, the second spool member 116 has shifted in the same direction so that a corresponding inner clearance groove 159, an inner radial passage 161 and a connector groove 162 permits the second signal port 68 to communicate with the second sump port 78 to scavenge fluid displaced through the second actuator port 42 to the sump 26. It is noted that the intermediate land 146 of the first spool member 115 effectively closes off all communication between the first helm port 73 and the first sump port 77 and thus pressure from the helm pump is blocked at the valve. Similarly, the second spool member 116 closes off the second helm port 74 and prevents leakage of supply fluid to the second signal port 68. Clearly, if the valve spool shifted rightwards in a relative direction of arrow 158, i.e. opposite to the arrow 157, the opposite flow direction would result. In this opposite position, supply fluid at the port 76 would pass through the second signal port 68 to the second actuator port 42, and fluid from the first actuator port 41 would pass through the signal port 67 to the first sump port 77.

When supply pressure at the port 76 drops below a threshold pressure, e.g. below about 150 p.s.i. (10.5 kg. per sq. cm.), force from the springs 119 and 120 forces the spool members towards each other to contact the centre stop 127 and attain the second configuration as shown in FIG. 6, thus closing the valve to supply fluid in the supply port 76. In this second configuration, with the centre stop 127 in the same position with respect to the port 76 as in FIG. 5, the signal supplied to the first helm port 73 passes through the passage 152 into the first connector groove 154, and into the passage 151 to the first signal port 67. Similarly, an outer clearance groove 164 in the member 116 communicates through an outer radial passage 165 with the second helm port 74 and, through the second connector groove 162, the inner passage 161 and the inner clearance groove 159, communicates with the second signal port 68. When the valve shifts in an opposite direction per the arrow 158, there is sufficient length in the four clearance grooves of the spool members to provide uninterrupted communication with the valve port as before. It can be seen that, when the spool portion 62 is in the second configuration as shown in FIG. 6, the fluid passing through the signal ports and the adjacent helm ports is unaffected by position of the valve spool.

In summary, it can be seen that the coil spring 119 and 120 serve as biasing means cooperating with the spool members to urge the spool members to the second configurations thereof. The supply port is located with respect to the spool members so that the supply fluid enters the valve body to act on the spool members in opposition to forces from the biasing means, tending to shift the spool members to the first configurations thereof. It can be seen that in the second configuration, the supply fluid is blocked by the valve spool and fluid from the helm pump is directed directly to the actuator apparatus, and the position of the valve spool is immaterial. To enable communication between the first signal port 67 and the adjacent first helm port 73 in the second configuration, irrespective of valve position, axial lengths 141 and 142 of the clearance grooves 137 and 138, and axial length 155 of the connector groove 154 must be sufficient to accommodate the port spacing 131 to provide continuous communication for the two extreme positions of the valve spool portions with respect to the valve body portion.

Thus, the inner and outer clearance grooves 137 and 138 and the connector groove 154 with associated radial passages 151 and 152 serve as a first spool clearance means of the spool portion, which has an axial length approximately equal to the said valve port spacing 131 plus twice the predetermined lost motion or axial spacing 108 (FIG. 4). This is to permit the first signal port and the first helm port to communicate with each other, irrespective of the valve position, when the valve spool members attain the second configuration. Similarly, the clearance grooves 159 and 162 and the connector groove 162 serve as second spool clearance means extending along the spool portion and similarly provide continuous communication between the second signal port 68 and the second helm port 74 irrespective of the valve position. Clearly, other spool clearance means can be provided which function similarly to provide communication between the pairs of adjacent signal ports and helm ports when the spool portion attains the second configuration.

OPERATION

Referring to FIG. 1, when the pump of the power pack 30 is operating correctly, supply fluid at supply pressure is fed to the support port 76. This pressure is within the range of between 300 and 1,000 p.s.i. (21 and 70.3 kg. per sq. cm.), which is sufficiently above the threshold pressure of 150 p.s.i. (10.5 kg. per sq. cm.). When there is no change in steering signal, there is no fluid flow in the helm lines 23 and 24, and thus no relative motion between the servo apparatus and actuator apparatus. Consequently, the actuator body and servo body are centered with respect to each other, the valve spool portion 62 remains centered within the valve body portion 61, and the signal ports 67 and 68 are consequently blocked by the spool members as shown in FIG. 2, and thus no fluid passes the signal ports.

If there is to be a change in the rudder steering angle, the wheel 20 is rotated, and fluid flows in the helm lines 23 and 24. In the following example, it is assumed that the wheel is rotated in such a direction as to output fluid along the first line 23, and return fluid along the second helm line 24. Thus, fluid in the line 23 enters the first branch line 57 and passes into the first servo port 55 and pressures the first helm port 73 of the valve body. Simultaneously fluid leaves the servo port 56 in the second line 58 and returns to the helm pump 19 and the valve, leaving the valve in the second sump line 58.

Referring to FIGS. 2 and 4, fluid transfer on opposite sides of the servo piston 48 causes the servo body 46 to shift in direction of the arrow 157, which is due to lost motion between the servo body 46 and the actuator body 36. Thus, the servo body shifts per the arrow 157 until the head portion 102 contacts the connector member 105 at the second end 84, which position is not shown. This shifting eliminates the lost motion at the end 84 so that the servo body is now displaced to a maximum leftwards position with respect to the actuator body. Movement of the servo body is transferred through the valve spool connector 80 to the valve spindle 113, which similarly shifts with respect to the valve body portion 61 in direction of the arrow 157 and thus assumes the leftwards displaced position as shown in FIG. 5. It can be seen that body coupling means 85 and 86 serve as a lost motion means for providing limited axial lost motion between the servo apparatus and the actuator apparatus. The lost motion means provide sufficient axial movement between the valve spool and the valve body to permit shifting of the valve portions relative to each other to change fluid flow through the main valve. It is noted at this time that there has been no movement between the actuator piston rod 37 and the actuator body 36 and thus there is no immediate change in the signal to the rudder.

Referring to FIG. 5, the shifting of the valve spindle 113 per the arrow 157 opens the first signal port 67 to supply fluid under pressure in the intermediate portion 128, which fluid flows through the first line 71 into the first actuator port 41. From the zero rudder signal position, with the servo apparatus centered per FIG. 2, the maximum leftwards displacement of the servo apparatus to that shown in FIG. 5 is determined by the said lost motion or axial spacing 108. This displacement is equal to maximum movement of the valve spool with respect to the body from the centered position of the valve spool. In order to obtain a reasonably fast response of the system, flow restriction through the valve should be reduced as much as possible so that volume flow into the actuator apparatus is not unduly restricted by the spool partially closing off a valve port.

Referring to FIGS. 1 and 2, because the actuator body is hingedly fixed on the mounting bracket 15, the reaction to fluid flowing into the first port 41 forces the actuator piston rod 37 in direction of the arrow 158. As the actuator rod is connected to the servo piston rod 47 by the rod connector 52, the servo rod similarly is urged in direction of the arrow 158, which would tend to move the servo body per arrow 158 if the servo apparatus was inactive. However, the servo rod is already extending from the servo body in proportion to fluid flow relative to the servo apparatus, which extension is faster than extension of the actuator rod due to difference in volume displacements between the servo and the actuator apparatus. As stated previously, the servo apparatus is a relatively low volume displacement cylinder when compared with the actuator apparatus, and thus the servo rod always leads the actuator rod. Thus, the leftwards minimum axial displacement of the servo body with respect to the actuator body due to lost motion between the servo body 46 and actuator body 36 does not change appreciably as long as sufficient fluid from the helm pump is fed into the first servo port 55, and fluid is returned to the helm pump through the second servo port 56. This signal state results in a continuing extension of the actuator piston rod 37, which increases angle of the rudder 17. Thus, during extension of the actuator piston rod 47, the second servo connector portion 96 is held against the second actuator connector portion 94 at the second end portion 84.

When the helm pump stops turning, fluid flow in the helm lines 23 and 24 stops, and thus there is no more relative movement between the servo piston rod and the servo body, thus locking the servo apparatus. The actuator piston rod continues to extend in the direction of arrow 158 for a short distance due to continued flow from the supply, and pulls the servo rod with it. As there is no relative movement between the servo piston rod 47 and the servo body 46 due to hydraulic locking by the valve 14, the servo body is also pulled with the servo rod in the direction of the arrow 158. This pulling moves the head portions 102 off the connector member 105 at the second end portion 84 due to the lost motion which permits a small relative axial movement between the servo body and actuator body. This small movement of the servo body is transferred through the spool connector 80 to the valve spindle 113, and is sufficient to move the valve spool portion in direction of the arrow 158 to the closed centre position of FIG. 2. This movement closes the signal port 67 to supply fluid which then prevents further extension of the actuator piston rod. Flow from the opposite side of the actuator piston 38 similarly ceases as the second signal port 68 is now closed by the second spool 116. Thus, the rudder is now locked in the new position until there is a signal change from the helm pump 19. It is noted that the lost motion between the actuator body and servo body is a portion of valve shifting means which is responsive to a change in fluid signal direction from the helm pump applied to the servo apparatus.

Referring to FIG. 6, if the supply pressure drops below the threshold pressure of about 150 p.s.i. (10.5 kg. per sq. cm.), the spool members 115 and 116 assume the centre position on the spindle 113 as shown due to force in the coil springs 119 and 120. In this position, the signal ports 67 and 68 are isolated from the supply fluid, and instead communicate directly with the helm pump. When there is no signal from the helm pump, flow in the lines 23 and 24 is stationary, and the body coupling means is centred as previously described.

When a signal from the helm pump 19 generates output flow in the line 23, and input flow into line 24, fluid passes into the first helm port 73, through the outer clearance groove 138, into the passage 152, into the connecting groove 154, into the passage 151, the clearance groove 137, and out through the first signal port 67 to be fed into the first actuator port 41. This forces the actuator piston in direction of the arrow 158 and actuates the rudder. Clearly, fluid scavenged through the second actuator port 42 returns to the helm pump through the second signal port 68, the inner clearance groove 159, the connector groove 162, the outer clearance groove 164, and the second helm port 74 into the second lines 58 and 24. Also, fluid from the helm pump also passes through the first servo port 54, and is scavenged from the servo cylinder through the second servo port 55 to return to the helm pump. Fluid flow from the helm pump will be proportioned between the actuator apparatus and the servo apparatus in an amount proportional to fluid volume displacements. In this configuration, the second actuator connector portion 94 and the second servo connector portion 96 at the second end portion 84 are in contact with each other, as a reaction to force from the extension of the servo piston rod. Thus, it can be seen that the pressure in both apparatus assist in applying force to the rudder, although the contribution from the servo apparatus is relatively small. Clearly, far higher manual force for turning the helm pump will be required when the supply fluid is at low pressure, than in the normal high pressure situation. When in the second configuration, the size of the lost motion between the servo body and the actuator body is not critical and merely permits the movement of the valve which has no affect on operation.

The major differences between the first and second configurations are as follows. In the first or high pressure configuration, supply fluid can pass into the supply port of the valve apparatus and leave through one of the signal ports, and returning fluid from the actuator apparatus passes through the valve body and out to the sump. Clearly, fluid from the helm pump is blocked by the valve spool. However, when the supply fluid pressure is less than the threshold pressure, and the valve attains the second or low pressure configuration, the supply fluid is blocked by the valve spool and fluid from and to the helm pump is directed directly to and from the actuator apparatus.

In the second configuration, essentially continuous communication between adjacent helm ports and signal ports can be assured by providing adequate overlap of the first and second clearance lengths with the respective ports. However, this requires that the inner ends of the spool members are pressed firmly against the centre stop 127 and this requires adequate strength in the springs 119 and 120 to hold the members against the centre stop 127, notwithstanding resistance due to sealing friction between the o-rings and the cup seals as the valve members are shifted. Preferably, there should be a relatively wide difference between normal operating supply pressure, that is, between approximately 300 and 1,000 p.s.i. (21 and 70.3 kg. per sq. cm.), and the threshold pressure, that is approximately 150 p.s.i. (10.5 kg. per sq. cm.), to ensure that the spring force is sufficient to overcome any sticking tendency of the spool members within the valve bore 132. It can be seen that the resiliently mounted spool members serve as a fluid directing means for directing fluid supplied to the main valve, and are themselves pressure responsive members which are responsive to supply fluid pressure. Thus, when supply fluid pressure is greater than the threshold pressure, the spool members move on the valve spindle so that supply fluid is fed into the actuator apparatus. Alternatively, when the supply fluid pressure is less than the threshold pressure, the spool members move on the valve spindle so that the main valve directs fluid from the helm pump to the actuator apparatus directly.

From the above it can be seen that shifting of the valve from the first to second configurations thereof occurs essentially instantaneously and automatically without any manual intervention of the operator. Consequently, in a critical situation in heavy seas, where power supply to the hydraulic pump might fail, the operator can maintain concentration and force on the helm wheel without reaching for other controls to bring in the manual backup system. This is a considerable advantage when compared with other systems wherein, upon loss of the hydraulic fluid pressure, the operator might be required to activate other controls while concurrently maintaining control of the helm.

ALTERNATIVES

In the foregoing description, the main valve has one valve portion connected to the actuator apparatus and another valve portion connected to the servo apparatus, and lost motion for actuating the main valve is provided by the body coupling means 85 and 86 between the servo body 46 and the actuator body 36. This arrangement includes a rigid connection between the valve spool and the servo body, the valve body and the actuator body, and the actuator piston rod and the servo piston rod. Clearly, several variations of the above are possible to attain similar benefits of the invention. For example, in one alternative structure, it is possible to interchange connections between the main valve portions and the servo apparatus and actuator apparatus. This could result in an alternative rigid connection between the valve spool and the actuator body, an alternative rigid connection between the valve body and the servo body and the same body coupling means. Also, in another alternative structure, it would be possible to provide lost motion in the connection between the actuator piston rod and the servo piston rod. In this particular alternative, the actuator piston rod is hinged to the boat hull for resisting forces during actuation of the actuator apparatus and the actuator body thus moves along the respective actuator rod. Other alternative structures are possible which provide lost motion between two components of the combination, which lost motion is sufficient to shift the valve spool with respect to the valve body to interchange fluid flows with respect to the actuator apparatus.

In the structure disclosed, when there is no change in the rudder signal, the supply fluid is blocked by the spool of the main valve and flow in the apparatus is essentially eliminated. As is known in the trade, some valves are designed to permit a continuous "leakage" of fluid from the supply which is returned to the sump after passing through the valve only. Clearly, the valve of the present invention could be modified to accommodate such leakage without any change in function. Also, as described, when the valve is fully opened, the valve does not restrict flow appreciably therethrough, thus permitting a sufficiently high flow of fluid into the actuator cylinder to provide a device with an adequate speed of response.

An alternative "zero lash valve" could be substituted for the valve disclosed but this is not recommended due to a relatively slow response. A zero lash valve has a spool requiring only a very small movement to effect valve change, thus requiring a correspondingly much smaller amount of lost motion between the main components. However, a zero lash valve restricts the flow considerably, and this would produce an apparatus with an impracticably slow speed of response. Consequently, the valve as disclosed is the preferred valve, which requires shifting of the spool considerably more than a zero lash valve but this is necessary to attain adequate fluid flow. Also, the fluid directing means shows spring-urged slidable spool members on the spool spindle. Other fluid pressure responsive means can be substituted.

I claim:

1. A fluid power apparatus comprising:

(a) an actuator apparatus having an actuator body and an actuator piston rod, the piston rod having an actuator piston mounted thereon, the actuator body having first and second actuator ports located on opposite sides of the piston, the actuator body and piston rod being mutually extensible and retractable along a longitudinal actuator axis, (b) a servo apparatus having a servo body and a servo piston rod, the servo piston rod having a servo piston mounted thereon, the servo body having first and second servo ports located on opposite sides of the servo piston and being communicable with a helm pump, the servo body and the servo piston rod being mutually extensible and retractable along a longitudinal servo axis, the servo axis being parallel to the actuator axis, (c) a main valve having a valve body portion and a valve spool portion, the valve body portion having: first and second signal ports communicating with the first and second actuator ports respectively of the actuator body to transmit fluid therebetween; first and second helm ports communicable with the helm pump to transmit fluid therebetween; a supply port to receive supply fluid at supply pressure when available; and at least one sump port communicable with a sump; the valve portions being movable relative to each other to control fluid flow through the ports of the valve body, portions of the main valve, the actuator apparatus and the servo apparatus being mechanically rigidly connected together for concurrent simultaneous movement, and (d) valve shifting means for shifting the main valve apparatus between first and second positions thereof to change supply fluid flow through the valve, the valve shifting means comprising lost motion means for providing pre-determined lost motion in at least one mechanical connection between two portions of either the main valve, the actuator apparatus or the servo apparatus, the lost motion means providing sufficient axial movement between the valve spool portion and the valve body portion to permit shifting of the valve portions relative to each other to change fluid flow through the main valve in response to a change in fluid signal direction from the helm pump applied to the servo apparatus.

2. An apparatus as claimed in claim 1 in which the valve shifting means comprises:

(a) the main valve having one valve portion rigidly connected to the actuator apparatus and another valve portion rigidly connected to the servo apparatus, the valve portions being shiftable relative to each other along a valve axis disposed parallel to the actuator axis and servo axis to change fluid flow through the valve, (b) the lost motion means providing the pre-determined lost motion in a mechanical connection between the servo apparatus and the actuator apparatus.

3. An apparatus as claimed in claim 1 further comprising:

(a) fluid directing means for directing fluid supplied to the main valve, the fluid directing means having a pressure responsive member communicating with the supply port of the main valve so as to be exposed to supply pressure, the pressure responsive member attaining a first or high pressure configuration when supply fluid pressure is greater than a threshold pressure, so that the main valve directs the supply fluid into the actuator apparatus, or alternatively, when the supply fluid pressure is less than the threshold pressure, the pressure responsive member automatically attains a second or low pressure configuration so that the main valve directs fluid from the helm pump to the actuator apparatus.

4. An apparatus as claimed in claim 1 in which the valve shifting means comprises:

(a) the servo piston rod and the actuator piston rod being connected rigidly together for concurrent movement along respective axes of extension and retraction, (b) the main valve having one valve portion connected to the actuator apparatus and another valve portion connected to the servo apparatus, the valve portions being shiftable relative to each other along a valve axis disposed parallel to the actuator axis and servo axis to change fluid flow through the valve, (c) body coupling means for coupling the actuator body to the servo body with sufficient clearance therebetween to provide the pre-determined lost motion therebetween to permit the servo body to move axially relative to the actuator body an amount sufficient to shift the main valve.

5. An apparatus as claimed in claim 4 in which the body coupling means comprises:

(a) the actuator body having first and second actuator connector portions provided with axially spaced apart first and second stops respectively, (b) the servo body having first and second servo connector portions provided with axially spaced apart first and second stops respectively, the first and second actuator connector portions being complementary to the first and second servo connector portions respectively, axial spacing between the stops of the actuator connector portion and the stops of the servo connector portion providing the said pre-determined lost motion.

6. An apparatus as claimed in claim 5 in which:

(a) the first and second connector portions of one body comprise first and second male means extending axially from the respective body, each male means having a neck portion and an expanded head portion of an outer end to serve as a stop, (b) the first and second connector portions of the remaining body comprise first and second female means with first and second openings therein, the openings being smaller than the respective head portions, and larger than the respective neck portions to permit a predetermined axial movement of the neck portion within the respective opening, the predetermined axial movement being equal to the said predetermined lost motion.

7. An apparatus as claimed in claim 4 in which:

(a) the valve body is connected rigidly to the actuator body, and (b) the valve spool is connected rigidly to the servo body for concurrent movement parallel to the actuator axis.

8. An apparatus as claimed in claim 3 in which:

(a) the valve spool portion serves as the pressure responsive member and is responsive to supply fluid pressure and is spring biased to the second or low pressure configuration so that, when the supply fluid pressure is greater than the threshold pressure, force from the spring bias is overcome by the supply fluid pressure and the valve spool portion attains the first or high pressure configuration, and the supply fluid can pass into the supply port of the valve apparatus and leave through one of the actuator ports, and the valve spool portion is positioned so that fluid from the helm pump is blocked by the valve spool portion; and when the supply fluid pressure is less than the threshold pressure, the spring bias force overcomes force from supply pressure and the valve spool portion attains the second or low pressure configuration, in which the valve spool portion is positioned so that the supply fluid is blocked by the valve spool, and fluid from the helm pump is directed by the valve spool to the actuator apparatus.

9. An apparatus as claimed in claim 8 in which:

(a) the valve spool portion includes a valve spindle, first and second spool members mounted on the spindle for axial movement therealong between respective first and second configurations, and biasing means cooperating with the spool members to urge the spool members to the second configurations thereof;

(b) the supply port being located with respect to the spool members so that the supply fluid enters the valve body to act on the spool members in opposition to forces from the biasing means tending to shift the spool members to the first configurations thereof.

10. An apparatus as claimed in claim 9 in which the valve shifting means comprises:

(a) the main valve having one valve portion connected to the actuator apparatus and another valve portion connected to the servo apparatus, the valve portions being shiftable relative to each other along a valve axis disposed parallel to the actuator axis and servo axis, (b) lost motion means for providing pre-determined lost motion between the servo apparatus and the actuator apparatus, the lost motion means providing sufficient axial movement between the valve spool and valve body to permit shifting of the valve portions relative to each other to change supply fluid flow through the main valve, and in which:

(c) the valve body portion includes the first signal port and the first helm port being spaced apart at a valve port spacing, and the second signal port and the second helm port being spaced apart at a similar valve port spacing, (d) the spool portion includes first and second spool clearance means extending therealong, each clearance means having an axial length approximately equal to the said valve port spacing plus twice the said predetermined lost motion to permit the first signal port and the first helm port to communicate with each other and the second signal port and the second helm port to communicate with each other irrespective of the position of the valve spool portion with respect to the valve body, which communication occurs when the valve spool members attain the second configuration.

11. An apparatus as claimed in claim 9 in which:

(a) the biasing means urges the spool members towards each other and towards an intermediate portion of the valve body, (b) the supply port is located adjacent the intermediate portion of the valve body.

12. An apparatus as claimed in claim 1 in which:

(a) the servo apparatus has a volume displacement which is less than corresponding volume displacement of the actuator apparatus.

13. An apparatus as claimed in claim 1 in which:

(a) the actuator piston rod and the servo piston rod pass through end portions of the respective cylinders so that, for relative movement between a particular cylinder and piston, equal volumes of fluid are displaced on opposite sides of the respective piston.

14. An apparatus as claimed in claim 1 in which the actuator apparatus, the servo apparatus and the main valve are located relative to each other so that longitudinal axes thereof are parallel to each other, and when viewed axially, the longitudinal axes form vertices of a triangle, so the servo apparatus, the actuator apparatus and the main valve are coupled in a non-planar array.

15. An apparatus as claimed in claim 14 in which:

(a) the actuator apparatus and the servo apparatus are located closely adjacent each other with longitudinal axes thereof disposed within a first plane, (b) the main valve is located closely adjacent the actuator apparatus so that the longitudinal axes of the actuator apparatus and the main valve are disposed within a second plane, the second plane being disposed at right angles to the first plane.

16. An apparatus as claimed in claim 15 in which:

(a) a valve connector extends between the servo apparatus and the main valve to connect one valve portion to the servo apparatus.

17. A steering apparatus for a marine vessel having a rudder, a helm pump, a pressurized fluid supply and a sump hydraulically interconnected, the steering apparatus comprising:

(a) an actuator apparatus having an actuator body and an actuator piston rod, the piston rod having an actuator piston mounted thereon, the actuator body having first and second actuator ports located on opposite sides of the piston, the actuator body and piston rod being mutually extensible and retractable along a longitudinal actuator axis, the actuator cooperating with the rudder, (b) a servo apparatus having a servo body and a servo piston rod, the servo piston rod having a servo piston mounted thereon, the servo body having first and second servo ports located on opposite sides of the servo piston and being in communication with the helm pump, the servo body and the servo piston rod being mutually extensible and retractable along a longitudinal servo axis, the servo axis being parallel to the actuator axis, (c) a main valve having a valve body portion and a valve spool portion, the valve body portion having: first and second signal ports communicating with the first and second actuator ports respectively of the actuator body to transmit fluid therebetween; first and second helm ports being in communication with the helm pump to transmit fluid therebetween; a supply port to receive supply fluid at supply pressure from the pressurized fluid supply when available; and at least one sump port in communication with the sump; the valve portions being movable relative to each other to control fluid flow through the ports of the valve body, portions of the main valve, the actuator apparatus and the servo apparatus being mechanically rigidly connected together for concurrent simultaneous movement, and (d) valve shifting means for shifting the main valve apparatus between first and second positions thereof to change supply fluid flow through the valve, the valve shifting means comprising lost motion means for providing pre-determined lost motion in at least one mechanical connection between two portions of either the main valve, the actuator apparatus or the servo apparatus, the lost motion means providing sufficient axial movement between the valve spool portion and the valve body portion to permit shifting of the valve portions relative to each other to change fluid flow through the main valve in response to a change in fluid signal direction from the helm pump applied to the servo apparatus.

18. An apparatus as claimed in claim 17 in which the valve shifting means comprises:

(a) the main valve having one valve portion rigidly connected to the actuator apparatus and another valve portion rigidly connected to the servo apparatus, the valve portions being shiftable relative to each other along a valve axis disposed parallel to the actuator axis and servo axis to change fluid flow through the valve, (b) the lost motion means providing the pre-determined lost motion in a mechanical connection between the servo apparatus and the actuator apparatus.

19. A steering apparatus as claimed in claim 17, further comprising:

(a) fluid directing means for directing fluid supplied to the main valve, the fluid directing means having a pressure responsive member communicating with the supply port of the main valve so as to be exposed to supply pressure, the pressure responsive member attaining a first or high pressure configuration when supply fluid pressure is greater than a threshold pressure, so that the main valve directs the supply fluid into the actuator apparatus, or alternatively, when the supply fluid pressure is less than the threshold pressure, the pressure responsive member automatically attains a second or low pressure configuration so that the main valve directs fluid from the helm pump to the actuator apparatus.

20. A steering apparatus as claimed in claim 17 in which the valve shifting means comprises:

(a) the servo piston rod and the actuator piston rod being connected rigidly together for concurrent movement along respective axes of extension and retraction, (b) the main valve having one valve portion connected to the actuator apparatus and another valve portion connected to the servo apparatus, the valve portions being shiftable relative to each other along a valve axis disposed parallel to the actuator axis and servo axis, (c) body coupling means for coupling the actuator body to the servo body with sufficient clearance therebetween to provide the pre-determined lost motion therebetween to permit the servo body to move axially relative to the actuator body an amount sufficient to shift the main valve.

* * * * *